US006530499B1

(12) United States Patent
Coleman et al.

(10) Patent No.: US 6,530,499 B1
(45) Date of Patent: Mar. 11, 2003

(54) DISPENSING AMUSEMENT DEVICE

(76) Inventors: Thomas J. Coleman, 19170 Paddock Pl., Abingdon, VA (US) 24211; William K. Schlotter, IV, 117 Wateredge La., Fredericksburg, VA (US) 22406; Princess Ann Coleman, 19170 Paddock Pl., Abingdon, VA (US) 24211; Ann M. Schlotter, 117 Wateredge La., Fredericksburg, VA (US) 22406

( * ) Notice: Subject to any disclaimer, the term of this patent is extended or adjusted under 35 U.S.C. 154(b) by 0 days.

(21) Appl. No.: 09/964,517

(22) Filed: Sep. 28, 2001

(51) Int. Cl.[7] ..... A24F 15/04
(52) U.S. Cl. ..... 221/24; 221/265
(58) Field of Search ..... 221/24, 155, 265, 221/277, 264, 82; 194/294, 296

(56) References Cited

U.S. PATENT DOCUMENTS

| | | | | |
|---|---|---|---|---|
| 2,694,480 A | * | 11/1954 | Mason | 194/297 |
| 2,880,906 A | * | 4/1959 | Probasco | 221/203 |
| 3,077,254 A | | 2/1963 | Goldfarb | |
| 3,638,350 A | | 2/1972 | Wiggen | |
| 3,810,535 A | * | 5/1974 | Phipps | 194/296 |
| 4,067,308 A | | 1/1978 | Anderson et al. | |
| 4,618,330 A | | 10/1986 | Abe | |
| 4,643,692 A | | 2/1987 | Magers | |
| 5,041,048 A | | 8/1991 | Lehmann | |
| 5,238,440 A | | 8/1993 | Morin | |
| 5,913,453 A | | 6/1999 | Coleman et al. | |

* cited by examiner

*Primary Examiner*—Kenneth W. Noland
(74) *Attorney, Agent, or Firm*—Clyde I. Coughenour

(57) ABSTRACT

A combined dispensing and amusement device has a reciprocating plunger on a transparent dome for rotating parallel disks. An upper first disk on an internal rotary housing supports articles and has an aperture that can aline with an aperture in a parallel adjacent lower second disk. The upper first disk frictionally drives the lower second disk at a lower speed so that the apertures periodically aline. Alinement of the apertures permits random dispensing of articles. Dispensing is into one of several chutes in the legs of a base support. Due to the random nature of dispensing, with the inclusion of indicia, the legs can be used as part of a game. Carousel arms on the internal rotary housing can act as stops and can variably deflect articles and/or can act as an animated indicia amusement support.

20 Claims, 3 Drawing Sheets

DISPENSING AMUSEMENT DEVICE

BACKGROUND OF THE INVENTION

1. Field of the Invention

The invention is to an article dispenser, such as a candy or gum dispenser, having a transparent dome and rotary internal housing including dispensing apertured parallel relatively rotating disks combined with amusements.

2. Description of Related Art

The prior art provides for dispensing candy and gum and for rotary movements for amusement by using spring loaded reciprocated plungers. As examples:

A. Morin, U.S. Pat. No. 5,238,440, issued Aug. 24, 1993, teaches a toy top having a transparent enclosure that houses balls supported on a stationary apertured base over a rotatable disk having a projection that passes through slots within pockets in the base to propel balls upwardly from the pockets and into the transparent enclosure. The rotation for the disk is provided by a twisted rod and clutch mechanism, a spring loaded plunger reciprocates a twisted rod that passes through a drive friction clutch mechanism that converts linear motion to rotary motion that is used for rotation of the disk.

A. Abe. U.S. Pat. No. 4,618,330, issued Oct. 21, 1986, teaches an amusement device that has a transparent cover with animated and rotating articles put in motion by pushing on a spring loaded plunger that uses gears to convert the reciprocating motion of the plunger into rotary motion.

A. Goldfarb, U.S. Pat. No. 3,077,254, issued Feb. 12, 1963, teaches a toy gum ball dispensing machine that dispenses gum balls from a transparent container by pressing a spring loaded valve with an opening that can pick up a gum ball, that falls through an aperture in the bottom of the container, and transports it to a sloping discharge chute that leads to plural differing value compartments, from where it is transported to a dispensing lip for removal.

Coleman et al, U.S. Pat. No. 5,913,453, issued Jun. 22, 1999, teach a candy or gum dispenser with a spring loaded chute at the base of a container. The spring holds the chute in a closed downward position. To dispense the contents of the container, pressure is applied to the container forcing the chute upwardly into the container exposing an opening in the upper chute. A candy or gum piece enters the opening and travels down the dispensing chute.

SUMMARY OF THE INVENTION

The invention device combines amusement and dispensing. A plunger sits over a transparent or translucent dome covering. A reciprocated rod on the plunger engages a clutch or gear means on a rotatable internal housing converting reciprocal motion into rotary motion. The lower extent of the rotary inner housing forms a first disk that acts as a support for articles and has an aperture in it. Beneath the first disk, a second disk, also having an aperture, is free to rotate on a supporting base. Friction between the rotary internal housing first disk and the second disk, turns the second disk in the same direction as the rotary internal housing but at a slower speed. The size and positioning of the two disks periodically aline the two apertures and allow an article to be passed through the two disks for random dispersal. Dispersing is into one of several chutes, formed within the legs of the base. Each of the legs can be labeled to represent something, such as indicia for a game. Article carousel arms on the rotary internal housing act in part as a stop or deflector for articles propelled upwardly from the rotary inner housing first disk and/or provide a support for amusement indicia that provides an animated display.

DESCRIPTION OF THE PREFERRED EMBODIMENT

Figure 1:
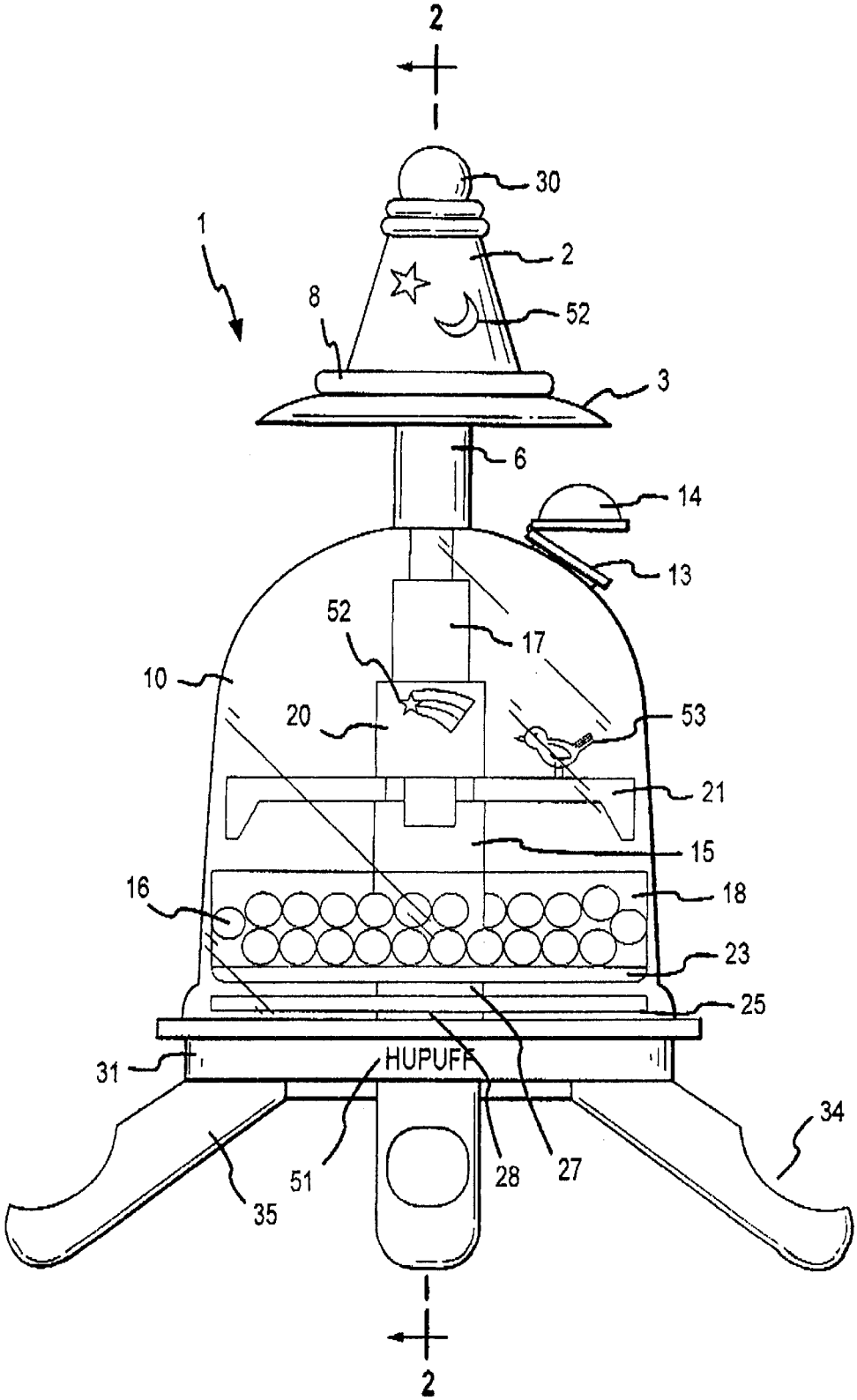
FIG. 1 is a side view of the dispensing amusement device of the invention.

The device of the present invention provides a pleasing, useful attraction that can maintain the attention and interest of children and adults alike. FIG. 1 is a side view of the dispensing amusement device 1. It shows a plunger 2, in the shape of a hat 8 having a brim 3 and indicia 52 on the hat. A spherical top palm press 30, provides for using the palm of the hand to press downwardly on the plunger 2, and the brim 3 can be used for finger and thumb pressing on the plunger. The plunger is over a stationary tube 6 that sits on top of a transparent dome 10. A lid 14 fits over a supply opening 13 that gives access into the dome interior. The rotary internal housing 20 is seen through the transparent dome with carousel arms 21 extending from a main housing 15 with a figure 53 on one carousel arm. The first disk 23, located at the lower end of the rotary internal housing, has an upwardly extending containment wall 18 that confines candy or gum 16 on the disk. An upper extension 17 conceals the motion transmitting rectangular spiral drive rod. The rotary internal housing is supported by a base 31 including legs 35 provided with dispenser openings 34. Random dispersal can be associated with game indicia 51 associated with each leg 35. Under the first disk a second disk 25 is positioned between low friction surface spacers 27, 28.

Figure 2:
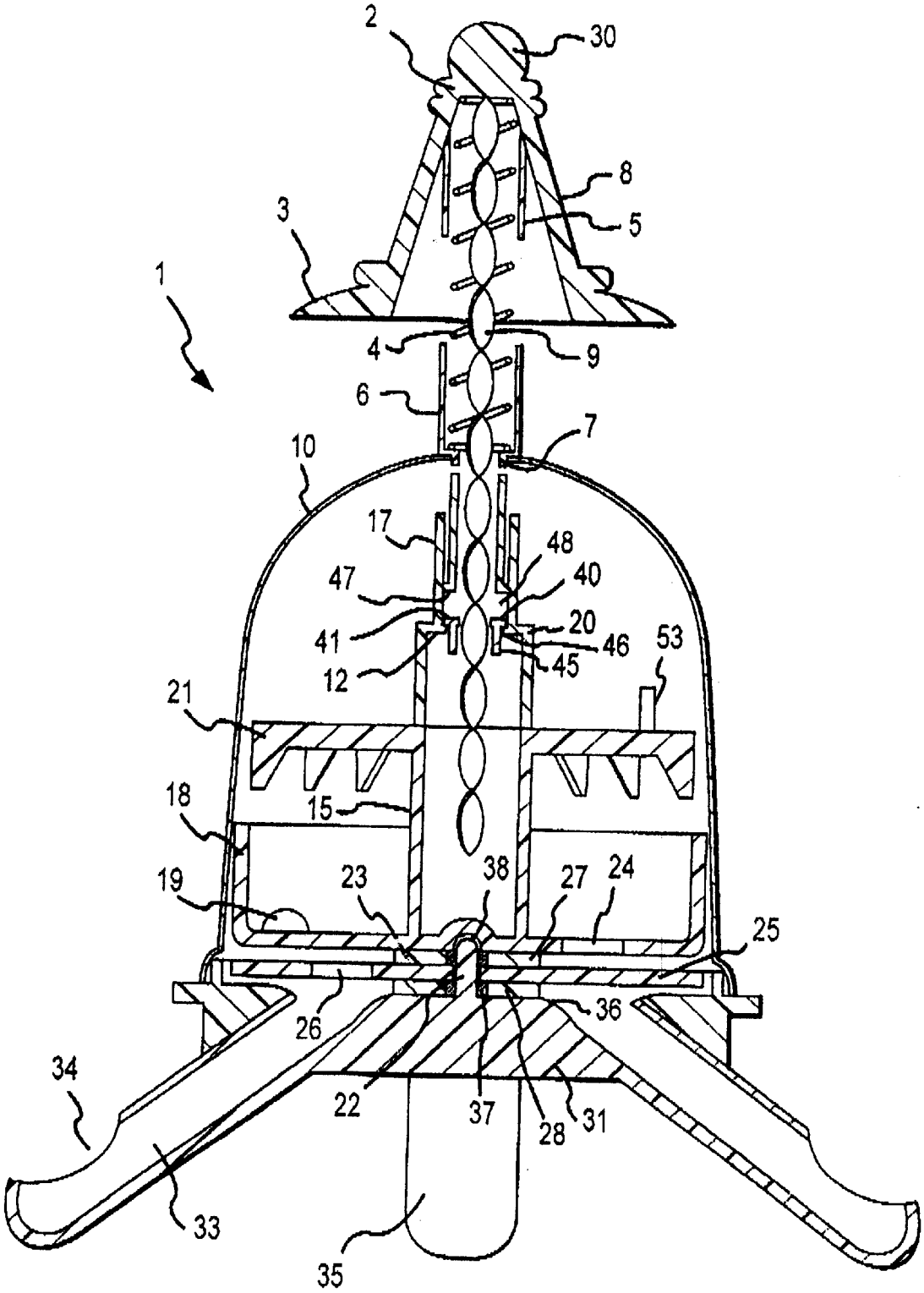
FIG. 2 is a cross-sectional view of the device along the section lines 2—2 shown in FIG. 1.
Figure 3:
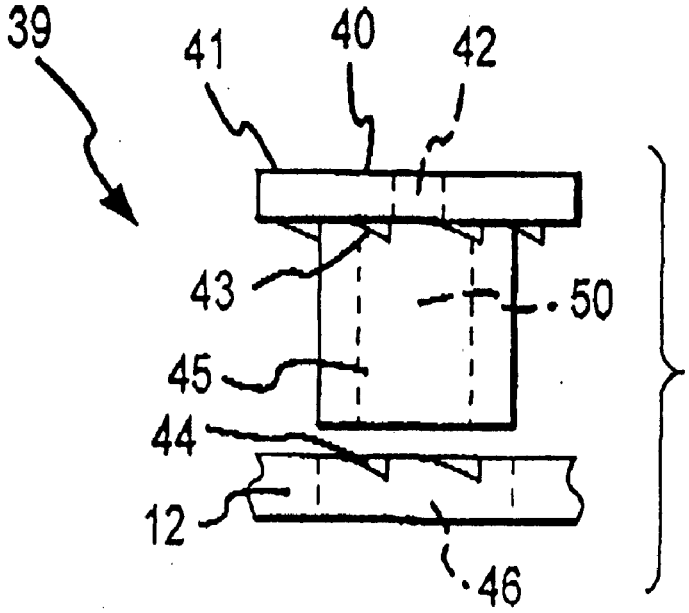
FIG. 3 is a side view of the clutch or gear means of the invention.
Figure 4:
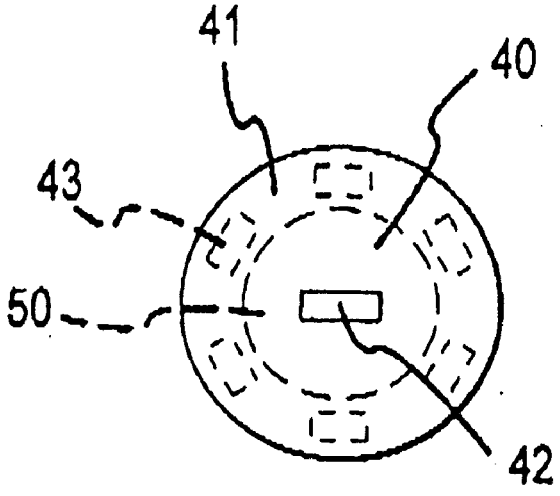
FIG. 4 is a top view of the clutch or gear drive.

The working details of the device 1 can be seen in FIGS. 2–4. A stationary base 31 supports a rotary internal housing 20 and a stationary transparent cover or dome 10, that in turn supports the plunger 2. The base includes a pivot pin 22 that passes through a central opening 37 in the second disk 25 and fits within a central alinement indentation or recess 38 formed in the bottom center of the first or primary disk 23. This alines the disks and radially positions apertures 24, 26 in them. The rotary inner housing is supported by the base through a lower spacer 28, that freely rotatably supports the second disk 25, and upper spacer 27, that supports the first rotary disk 23 that is or can be an integral part of the internal rotary housing 20.

The plunger 2 is positioned at the top of the transparent dome 10. The plunger has a rectangular spiral drive rod 9 attached to it or as an integral part of it and is provided with an alinement tube 5 that surrounds the upper portion of a return spring 4. A stationary tube 6 is placed between the transparent dome and the plunger to limit downward movement of the plunger and to house a portion of the return spring and rectangular spiral drive rod. The alinement tube 5 fits inside the stationary tube to position the rectangular spiral drive rod and assist its linear movement into the rotary internal housing 20. A return spring stop 7 can be used to position and maintain the lower end of the return spring at the top of the transparent dome.

Rotation of the rotary internal housing and disks is by way of the plunger 2. Depression of the plunger 2 reciprocates a rectangular spiral drive rod 9 against a return spring 4. The downward movement of the plunger passes the rectangular spiral drive rod through a clutch means 39. The rectangular spiral drive rod passes through a rectangular slot 42 of a drive gear 40, best seen in FIGS. 3 and 4. The drive gear is provided with a hollow downwardly projecting skirt 45 that projects through an opening 46 in a driven gear flange 12 at the upper end of a rotary internal housing 20 and the lower surface of the flange 41 of drive gear 40 tends to seat against the upper surface of the driven gear flange 12. The hollow flange 41 provides a passage 50 for the rectangular spiral drive rod 9. As the drive gear 40 cannot move downwardly as the rectangular spiral rod 9 moves down through it, the spiral of the rod causes the drive gear to rotate. As the drive gear rotates, due to gravity and friction created between the drive gear and the rectangular spiral drive rod, the tapered drive protrusions 43 on the flange 41 lower surface of the drive gear enter into the recesses of the tapered slots 44 of the driven gear flange 12 upper surface on the inner housing 20. The tapered slots can be integral with the rotary internal housing or a separate element attached thereto. With the tapered drive protrusions engaged in the tapered slots, rotation of the drive gear causes the inner housing 20 to rotate. The inner housing rotates about the pivot pin 22. Release of pressure from the plunger 2 allows the return spring 4 to raise the rectangular spiral drive rod back through the drive gear 40 slot 42. The reverse rotation of the rectangular spiral drive rod 9 in the slot 42 reverses the rotation of the drive gear and moves it upwardly. The rapid upward movement and reverse rotation disengages the tapered drive protrusion from the tapered slot in the rotary internal housing. This rapid disengagement permits free rotation of the rotary internal housing.

The drive gear 40 and driven gear 12 are within an enclosure 48. Just as the rectangular spiral drive rod 9 presses downwardly on the drive gear 40 the flange 41 of the drive gear against the driven gear flange 12 prevents the drive gear from leaving the enclosure 48 at the bottom, the enclosure upper wall flange 47 and drive skirt 49 prevent removal from the top. As the rectangular spiral drive rod 9 is withdrawn upwardly by the spring 4, the upper surface of the flange 41 of the drive gear engages the limit flange 47 on the upper wall of the enclosure to stop upward movement of the drive gear. The skirt 45 on the drive gear within the opening 46 in the flange driven gear 12 is long enough to not raise above the driven gear flange 12. This results in a smooth transition and operation when converting from reciprocal to rotary motion and when raising the rectangular spiral drive rod and drive gear from the driven gear for permitting free rotation of the rotary internal housing.

Free rotation of the inner housing includes free rotation of the attached or integral primary first disk 23 having the articles 16 thereon, such as candies or gum. Below and adjacent to the primary first disk a parallel second or secondary disk 25 is supported by the base 31. The second disk is free to rotate as it is supported by the base through the lower spacer 28, and it in turn supports the first disk 23 through the upper spacer 27. The spacers have a low friction surface so as to transmit rotation to the second disk 25 from the rotating first disk 23. The second disk rotates slower than the first disk because of inertia and the small friction that does exist between the two disks created by the upper spacer 27, and because of the small friction from the lower spacer 28. Any rotation of the lower spacer is subject to drag due in part to pressure against the stationary base 31. High speed does not allow enough time for gravity to pass an article through the alined adjacent apertures 24, 26, as they rotate relative to one another. As the rotation of the disks slows down due primarily to friction, the apertures within the disks eventually aline long enough for an article or candy on the first disk to pass through both the aperture 24 in the first disk and the aperture 26 in the second disk and to randomly fall into one of four sloped or tapered areas 36 on the base, into one of the four dispenser chutes 33 within base legs 35, to a dispenser opening 34 at the bottom of the chute. The chute traversed depends on the sloped or tapered area 36 of the base upper surface at the location the article happens to pass through the apertures 24, 26. The slope will be toward the nearest leg 35 of the base. A variety of indicia 51 can be provided on or adjacent to each leg for amusement or entertainment purposes, such as playing a game.

Indicia 52 or figures of articles, animals, etc. 53 can be attached to the rotary internal housing 20 upper extension 17 and/or main housing 15 and/or on carousel arms 21 and carried or placed inside or outside the stationary transparent cover. Additionally, the plunger 2 can be formed in the shape of various articles or animals, including shapes associated with the indicia placed on the rotary internal housing. The shape of the plunger 2 at the brim 3, and spherical top 30, such as that shown as a hat 8, can accommodate a finger and/or thumb or a hand palm.

For animation, the primary first disk 23 can be provided on its upper outward surface with one or more raised humps 19 that can propel upwardly any article placed on the prinary first disk 23 during rotation, due to inertia and impact. Midway up the rotary internal housing main housing 15 carousel arms 21 extend outwardly. These carousel arms are spaced apart and extend radially outwardly so that there is enough space at the outer ends of the arms to pass an article through unobstructed at these outer areas. The arms tend to deflect angularly articles propelled upwardly by the raise raised humps 19 that do not directly strike the base of the arms, and reject back downwardly articles that directly strike the base of the arms. The arms also provide a support for amusement pieces or figures 53 that can be placed thereon.

It can be seen that pressing on the plunger 2 causes the rotary internal housing 20 to rotate, setting the indicia 52 on the rotary housing in motion and the figures 53 on the carousel arms in motion, and the rotation of the humps 19 on the first disk 23 to propel loose articles 16 upwardly, due to impact and the changing speed of the first disk and the inertia of the articles. The carousel arms 21 being spaced allows some articles to pass upwardly therethrough, blocks some articles back downwardly, and randomly deflects other articles in different directions for a continuously changing scene within the transparent dome during rotation of the rotary internal housing. For added variety, different size, shape and/or color articles can be used. Together a pleasing animation is achieved in addition to the dispensing of articles and game that can be associated with the random article dispersal.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. An amusement dispensing device comprising:

a first disk and a second disk;

said first disk and said second disk being supported parallel to and adjacent to each other on a stationary base;

an aperture in said first disk and an aperture in said second disk;

means for rotating said first disk-and said second disk relative to one another;

said aperture in said first disk and said aperture in said second disk periodically aline with each other to pass an article supported on said first disk through said first disk aperture and through said second disk aperture as said first disk and said second disk rotate relative to one another.

2. An amusement dispensing device as in claim 1 wherein:

a transparent dome houses and extends over said first disk and said second disk.

3. An amusement dispensing device as in claim 2 wherein:

a spring loaded plunger is located above said transparent dome.

4. An amusement dispensing device as in claim 3 wherein:

said means for rotating said first disk and said second disk includes a rectangular spiral drive rod on said plunger.

5. An amusement dispensing device as in claim 4 wherein:

a stationary stop tube surrounds said rectangular spiral drive rod under said plunger and limits downward movement of said plunger;

said plunger has an alinement tube thereunder for positioning said spring and for guiding said plunger into said stationary stop tube.

6. An amusement dispensing device as in claim 4 wherein:

said means for rotating said first disk and said second disk includes a clutch means that is driven by said rectangular spiral drive rod on said plunger.

7. An amusement dispensing device as in claim 6 wherein:

said clutch means engages said rectangular spiral drive rod on said plunger to convert the linear motion of said plunger into the rotary motion of said first disk and said second disk.

8. An amusement dispensing device as in claim 7 wherein:

said clutch means has a drive gear with a rectangular slot therein that said rectangular spiral drive rod passes through to convert the linear motion into rotary motion;

said clutch means has a flange driven gear that engages said drive gear as said rectangular spiral drive rod passes downwardly through said rectangular slot in said drive gear.

9. An amusement dispensing device as in claim 8 wherein:

a rotary internal housing has an enclosure formed therein wherein said drive gear of said clutch means engages said rectangular spiral drive rod;

said rotary internal housing enclosure has side walls and an upper limiting flange to limit separation between said drive gear and said flange driven gear;

said drive gear has a lower skirt to aline and guide said drive gear within said flange driven gear.

10. An amusement dispensing device as in claim 8 including:

an rotary internal housing of which said first disk is an integral part;

said drive gear having a flange with tapered protrusions on the bottom and said flange driven gear having matching tapered recesses on the upper surface for creating a one direction rotation of said rotary internal housing.

11. An amusement dispensing device as in claim 2 including:

a rotary internal housing within said transparent dome;

said rotary internal housing rotatable by said means for rotating said first disk and said second disk;

said first disk is integral with said rotary internal housing lower extent;

said first disk outer extreme extends upwardly to form an article containment wall;

carousel arms extending outwardly from a main housing of said rotary internal housing above said first disk.

12. An amusement dispensing device as in claim 11 including:

an upwardly extending hump on the upper outward surface of said first disk for propelling articles thereon upwardly toward said carousel arms, and;

figures on said carousel arms for providing an animated amusement display.

13. An amusement dispensing device as in claim 1 wherein:

said second disk is rotated by said first disk by friction between said first disk and said second disk.

14. An amusement dispensing device as in claim 1 wherein:

said second disk is supported on said base by a lower spacer and said first disk is supported on said second disk by an upper spacer.

15. An amusement dispensing device as in claim 14 wherein:

said lower spacer has surfaces that create a small frictional force between said stationary base and said second disk and said upper spacer has surfaces that create a small frictional force between said second disk and said first disk so that rotating said first disk rotates said second disk but at a slower speed than that of said first disk.

16. An amusement dispensing device as in claim 1 including:

a pivot pin on said base;

said pivot pin passes through a central opening in said second disk and into a central alinement indentation in said first disk to aline said first disk and said second disk and to radially position said aperture in said first disk and said aperture in said second disk with one another so that they are adjacent to one another periodically.

17. An amusement dispensing device as in claim 1 wherein:

said base is provided with plural legs for supporting said amusement dispensing device;

said legs are each provided with a passage that forms a chute for articles;

said legs each have a dispensing opening at their lower ends for article removal;

a tapered surface on said base upper surface is provided for guiding an article to the nearest passage within said legs.

18. An amusement dispensing device as in claim 17 including:

different indicia associated with each leg for amusement associated with a randomly dispensed article;

said plunger formed in the shape of an object.

19. An amusement dispensing device comprising:

a base, a transparent dome on said base, a rotary internal housing having an upper end and a lower end within said transparent dome;

a first disk attached to said rotary internal housing lower end for supporting articles;

a hump on said first disk upper surface;

means for rotating said rotary internal housing within said transparent dome such that articles placed on said first disk are propelled upwardly by said hump on said first disk;

carousel arms extending outwardly from said rotary internal housing between said upper end and said lower end;

said carousel arms radially spaced apart so that randomly upwardly propelled articles can pass undisturbed between said carousel arms outer areas, can be blocked and prevented from upward movement, or can be deflected at random angles, to provide a continuously changing display during rotation of said first disk.

20. An amusement dispensing device as in claim 19 wherein:

a figure is placed on said carousel arm providing an animated display;

an aperture is provided in said first disk for dispensing articles therethrough.

* * * * *